US007117767B1

(12) United States Patent
Kiat

(10) Patent No.: US 7,117,767 B1
(45) Date of Patent: Oct. 10, 2006

(54) DOUBLE OPEN-END CLADED-HEAD WRENCH

(76) Inventor: Goh Seng Kiat, 768 S. Turnbull Canyon Rd., City of Industry, CA (US) 91745

( * ) Notice: Subject to any disclaimer, the term of this patent is extended or adjusted under 35 U.S.C. 154(b) by 1 day.

(21) Appl. No.: 11/130,774

(22) Filed: May 18, 2005

(51) Int. Cl.
*B25B 13/08* (2006.01)

(52) U.S. Cl. ..... 81/125.1; 81/119

(58) Field of Classification Search ..... 81/119, 81/125.1, 186, 900
See application file for complete search history.

(56) References Cited

U.S. PATENT DOCUMENTS 3,709,073 A * 1/1973 Kurtz ..... 81/119
6,202,515 B1 * 3/2001 Denton ..... 81/177.1
6,276,241 B1 * 8/2001 Cornog et al. ..... 81/170
6,354,175 B1 * 3/2002 Dobson et al. ..... 81/119
D476,204 S * 6/2003 Chang-Kao ..... D8/28
6,820,521 B1 * 11/2004 Dobson et al. ..... 81/119
2002/0011136 A1 * 1/2002 Eggert et al. ..... 81/125.1

* cited by examiner

*Primary Examiner*—David B. Thomas
(74) *Attorney, Agent, or Firm*—Alberta O. Cota

(57) ABSTRACT

A double open-end claded-head wrench (10) that is particularly designed to loosen and tighten hexagon bolts and nuts that are made of a relatively soft metal such as aluminum. The wrench (10) is made of aluminum and includes a wrench handle (12), a first open-end head (28), and a second open-end head (56), a notch (50) that is cut into the corners of each of the wrenches hexagon angles, and a stainless steel head clad (80–86) that covers the upper and lower surfaces (14,16) of the first and second open end heads (28,56). The notches prevent the corners of the aluminum bolts or nuts from being worn by the gripping pressure applied by the heads of the wrench (10). The stainless steel claded heads (28,56) protect the wrench heads (28,56) from being worn from repeated uses of the wrench (10).

19 Claims, 2 Drawing Sheets

DOUBLE OPEN-END CLADED-HEAD WRENCH

TECHNICAL FIELD

The invention pertains to the general field of hand-held open-end wrenches, and more particularly to a double open-end claded-head wrench that prevents the corners of a hexagon bolt or nut from being worn and that also minimizes the wear on the wrench heads.

BACKGROUND ART

To conserve weight on many devices, such as on bicycles used by professional riders, aluminum bolts and nuts are used to adjust and/or secure many of the bicycle's components. When a conventional steel wrench is used to tighten or loosen aluminum bolts or nuts the interfacing pressure applied to the corners of the bolt or nut head can, after repeated uses, round the corners of the bolt or nut head. The rounded corners make it difficult for a wrench to acquire a secure grip on the bolt or nut head, which in turn, causes wrench slippage that further aggravates and increases the rounded corners on the head of the bolt and nut.

The above-described problem is solved by the double open-end closed-head wrench described herein.

A search of the prior art did not disclose any industry literature or patents that read directly on the claims of the instant invention.

DISCLOSURE OF THE INVENTION

The double open-end claded-head wrench is specifically designed to tighten and loosen bolts and nuts that are made of a relatively soft material such as aluminum. The wrench prevents the aluminum bolts and nuts from having their corners rounded which can occur when a conventional steel wrench is used.

In its basic design, the double open-end claded-head wrench is comprised of:

A. A wrench handle having integrally attached:

1. A first open-end head having a stepped first side, a stepped second side, and four sides with three corners that correspond to the four sides and the three corners of a partial hexagon. Each of the corners further has a notch that removes a section of the apex located at each of the three corners of the wrench's partial hexagon.
2. A second open-end head having a stepped first side, a stepped second side, and four sides with three corners that correspond to the four sides and the three corners of a partial hexagon. Each of the corners further has a notch that removes a section of the apex located at each of the three corners of the wrench's partial hexagon.

B. A first and second head plate dimensioned to fit into and to be attached by an attachment means respectively to the stepped first and stepped second sides of the first open-end head. A third and fourth head plate are likewise dimensioned to fit into and to be attached by an attachment means respectively to the stepped first and stepped second sides of the second open-end head.

The wrench handle and the integrally attached first and second open-end heads are made of a metal that is softer than the metal used to make the first, second, third and fourth head plates. The preferred metal for making the open-end heads is aluminum, and the preferred metal for the head plates is a hardened steel such as stainless steel.

The notches on the three corners of the open-end heads isolate the corners of the aluminum bolt head or bolt nut from the bolt and nut gripping surfaces of the wrench. Thus, the corners are not touched and remain as square corners. The hardened stainless steel head plates protect the softer aluminum bolt and nut-gripping surfaces of the open-end heads from excessive wear.

In view of the above disclosure, the primary object of the invention is to produce a double open-end claded-head wrench that is particularly designed to tighten and loosen aluminum bolts and nuts. The wrench includes corner notches that encompass and prevent the corners of the aluminum bolt and nut heads from wearing smooth. The wrench also includes double open-end heads that are claded with stainless steel to protect the gripping surfaces of the open-end heads from excessive wear.

In addition to the primary object of the invention it is also an object of the invention to produce a double open-end claded-head wrench that:

can be made in various metric and English sizes, can be anodized in various colors for protection, is relatively lightweight, and is cost effective from both a manufacture's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
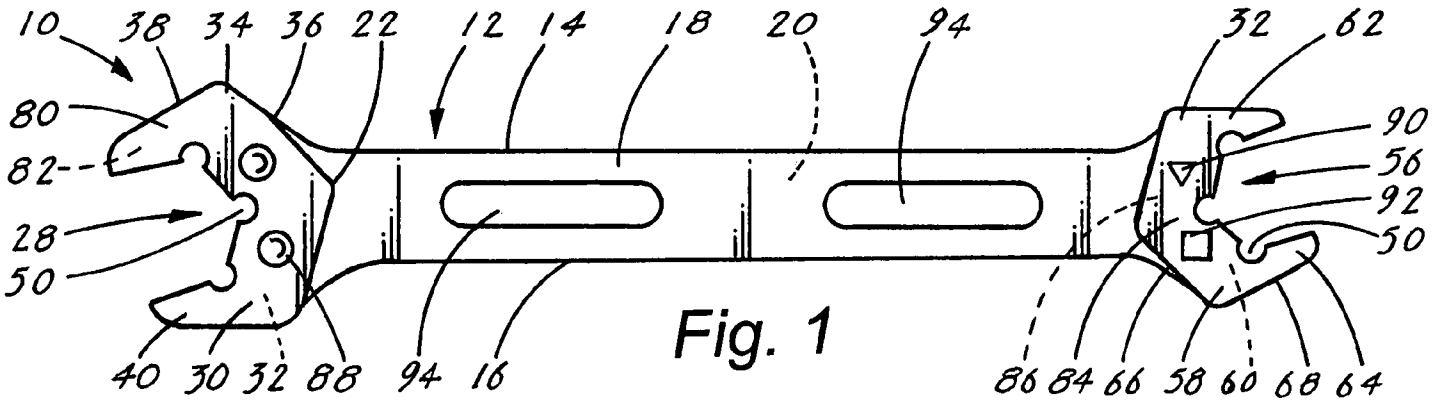
FIG. 1 is a front elevational view of an assembled double open-end claded head wrench. The rear elevational view being a mirror image thereof.

The best mode for carrying out the invention is presented in terms of a preferred embodiment for a double open-end claded-head wrench 10. The preferred embodiment, as shown in FIGS. 1–9, is comprised of five elements: a wrench handle 12, a first head plate 80, a second head plate 82, a third head plate 84, and a fourth head plate 86. The double open-end claded-head wrench 10, in its assembled configuration is shown in FIGS. 1–4 and the wrench 10 in an unassembled configuration is shown in FIGS. 5–8.

Figure 2:
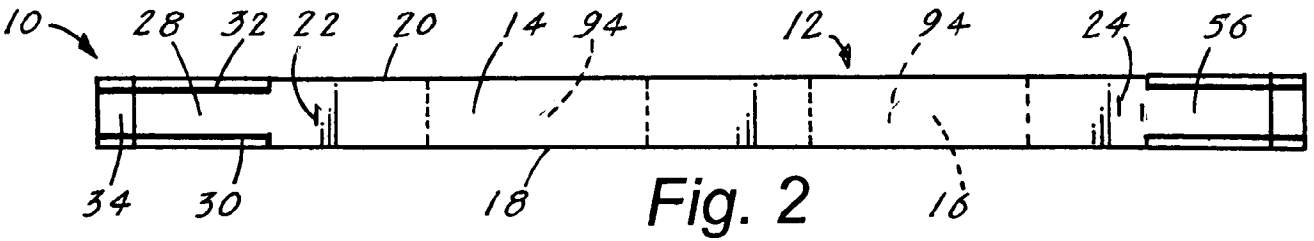
FIG. 2 is a top plan view of the assembled wrench
Figure 3:
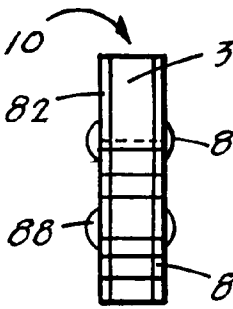
FIG. 3 is a front elevational view of the first open-end head of the assembled wrench.
Figure 4:
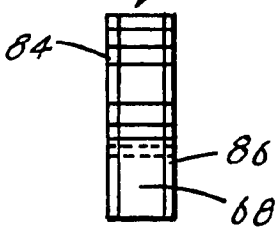
FIG. 4 is rear elevational view of the second open-end head of the assembled wrench
Figure 8:
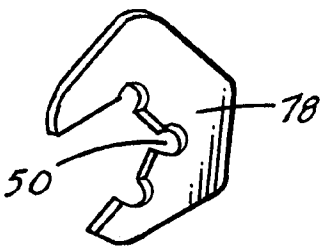
FIG. 8 is a perspective view of a typical head plate.
Figure 5:
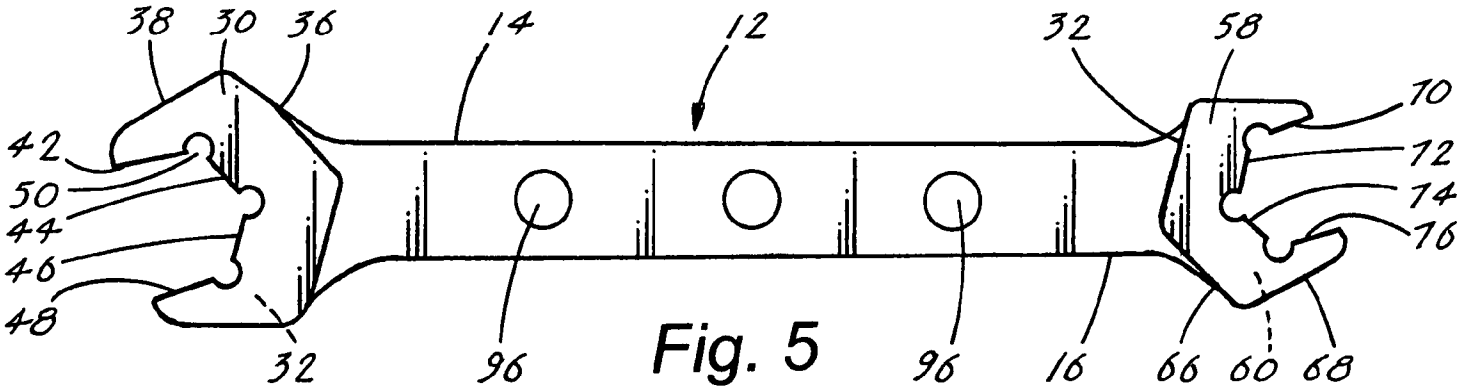
FIG. 5 is a front elevational view of the wrench showing the stepped first and second sides prior to having the respective head plates attached. The rear elevational view being a mirror image thereof.

The wrench handle 12, as shown in FIGS. 1, 2 and 5, is comprised of an upper surface 14, a lower surface 16, a first side 18, a second side 20, a first end 22, and a second end 24. To the first end 22 is integrally attached a first open-end head 28, and to the second end 24 is integrally attached a second open-end head 56.

The first open-end head 28 has a stepped first side 30, a stepped second side 32, an upper section 34, and a lower section 40. The upper section 34, as shown in FIGS. 1 and 5, has a first angle 36 that extends upward from the plane of the upper surface 14 of the wrench handle 12. Contiguously extending outward and downward from the first angle 36 is a second angle 38, as also shown in FIGS. 1 and 5. The first angle 36 has a slope that can range from 30 to 40 degrees, with a preferred slope of 35 degrees. The second angle 38 has a slope that can range form 25 to 35, degrees with a preferred slope of 30 degrees. The lower section 40, as also shown in FIGS. 1 and 5, is offset from and is substantially parallel to the lower surface 16 of the wrench handle 12.

The first open-end head 28 has four sides: a first side 42, a second side 44, a third side 46, and a fourth side 48. The four sides include the three corners of a partial hexagon. Each of the corners has a notch 50 that removes a section of the apex located at the three corners of the partial hexagon.

The second open-end head 56 has a stepped first side 58, and a stepped second side 60, an upper section 62, and a lower section 64. The upper section 62, as shown in FIGS. 1 and 5, is offset and is substantially parallel to the upper surface 14 of the wrench handle 12. The lower section 64, as also shown in FIGS. 1 and 5, has a first angle 66 that extends downward from the lower surface 16 of the wrench handle 12. Contiguously extending outward and upward from the first angle 66 is a second angle 68. The first angle 66 has a slope that can range from 30 to 40 degrees, with preferred slope of 35 degrees. The second angle 68 has a slope ranging from 25 to 35 degrees, with an angle of 30 degrees preferred.

As with the first open-end head 28, the second open-end head 56 also has four sides: a first side 70, a second side 72, a third side 74, and a fourth side 76. The four sides have three corners that correspond to the four sides and the three corners of a partial hexagon. Each of the corners have a notch 50, i.e. a circular bore 50, as shown in FIGS. 1 and 5, that removes a section of the apex located at each of the three corners.

The notch prevents the double open-end claded-head wrench from rounding or otherwise wearing-down a corner of an aluminum hexagon bolt or nut when pressure is being applied during a tightening or a loosening operation.

The wrench handle 12 has a thickness that can range from 0.25 to 0.5 inches (0.635 to 1.27 cm) and a width that can range from 0.5 to 0.75 inches (1.27 to 1.91 cm). The stepped first side 30,58 and the stepped second side 32,60 range in thickness from 0.031 to 0.094 inches (0.79 to 0.24 cm).

The second major element that comprises the double open-end claded-head wrench 10 are the four head plates: a first head plate 80, a second head plate 82, a third head plate 84, and a fourth head plate 86.

The first head plate 80 is dimensioned to fit into the stepped first side 30, and the second head plate 82 is dimensioned to fit into the stepped second side 30. Likewise, the third head plate 84 is dimensioned to fit into the stepped first side 58, and the fourth head plate 86 is dimensioned to fit into stepped second side 60.

The four head plates are attached to their respective stepped sides by an attachment means, as shown in FIG. 1, which can include at least two blind rivets 88, a spot-welding process 90 or an adhesive 92. The four head plates range in thickness from 0.031 to 0.094 inches (0.79 to 0.24 cm), which is the same thickness as the stepped area of the open-end heads. Thus, when the plates are attached they are flush with the first and second sides 18,20 of the handle 12, as shown best in FIG. 2. The wrench handle 12 and the integrally attached first and second open heads 28,56 are made of a metal that is softer than the metal used to make the first, second, third and fourth head plates. Typically, the wrench handle 12 and the open heads 28,56 are made of an aluminum alloy that is preferably anodized. The first, second, third and fourth head plates are typically made of a hardened steel such as stainless steel. Therefore, when the wrench is used to loosen or tighten a hexagon bolt or nut, the stainless steel plates protect the interfacing inner surfaces of the first and second open-end heads from being worn from repeated uses.

To lighten the weight of the double open-end claded-head wrench 10, the wrench handle 12 can include a plurality of openings, such as at least one or preferably two slots 94, as shown in FIG. 1, or a plurality of bores 96, as shown in FIG. 5. As shown in FIGS. 1 and 5, the first open-end head 28 and the second open-end head 56 are dimensioned to accommodate different sizes of bolts and nuts. Additionally, the wrench 10 can be produced in various metric and English sizes.

Figure 9:
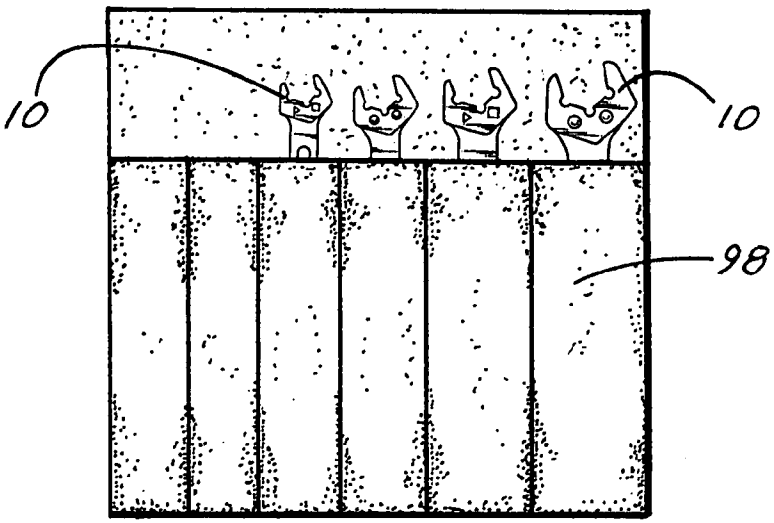
FIG. 9 is an elevational view of a typical roll-up pouch that houses a plurality of wrenches.
Figure 7:
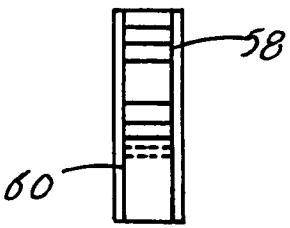
FIG. 7 is an elevational end view of the wrench showing the stepped first and second sides of the second open-end head.
Figure 6:
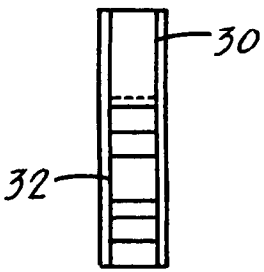
FIG. 6 is an elevational end view of the wrench showing the stepped first and second sides of the first open-end head.

The final element that comprises the invention is a roll-up pouch 98 that can accommodate various quantities of wrenches 10 when the wrenches are not in use. A typical pouch 98 is shown in FIG. 9.

While the invention has been described in detail and pictorially shown in the accompanying drawings it is not to be limited to such details, since many changes and modifications may be made to the invention without departing from the spirit and the scope thereof. For example, the first and second open-end heads can be dimensioned to fit other geometrically shaped heads such as an octagon shape or other specially shaped heads. Hence, it is described to cover any and all modifications and forms, which may come within the language and scope of the claims.

The invention claimed is:

1. A double open-end claded-head wrench comprising:

a) a wrench handle having integrally attached:

(1) a first open-end head having a stepped first side, a stepped second side, and four sides with three corners that correspond to the four sides and the three corners of a partial hexagon, with each of the corners further having a notch that removes a section of the apex located at each of the three corners of said wrench's partial hexagon, (2) a second open-end head having a stepped first side, a stepped second side, and four sides with three corners that correspond to the four sides and the three corners of a partial hexagon, with each of the corners further having a notch that removes a section of the apex located at each of the three corners of said wrench's partial hexagon, and b) a first and second head plate dimensioned to fit into and to be attached by an attachment means respectively to the stepped first and stepped second sides of the first open-end head, and a third and fourth head plate dimensioned to fit into and to be attached by an attachment means respectively to the stepped first and stepped second sides of the second open-end head.

2. The wrench as specified in claim 1 wherein said wrench handle and the integrally attached first and second open-end heads are made of a metal that is softer than a metal used to make said first, second, third and fourth head plates.

3. The wrench as specified in claim 2 wherein said means for attaching said first, second, third and fourth head plates is selected from the group consisting of at least two blind rivets, a welding process and an adhesive.

4. A double open-end claded-head wrench comprising;

a) a wrench handle having an upper surface, a lower surface, a first side, a second side, a first end, and a second end, b) a first open-end head integrally attached to the first end of said wrench handle, wherein said first open-end head having:

(1) a stepped first side, (2) a stepped second side, (3) an upper section having a first angle that extends upward from the upper surface of said wrench handle, and a contiguous second angle that extends outward and downward from the first angle, (4) a lower section that is offset from and substantially parallel to the lower surface of said handle, wherein said first open-end head has four sides with three corners that correspond to the four sides and the three corners of a partial hexagon, with each of the corners having a notch that removes a section of the apex located at the three corners of the partial hexagon, c) a second open-end head integrally attached to the second end of said handle, wherein said second open-end head having:

(1) a stepped first side, (2) a stepped second side, (3) an upper section that is offset and is substantially parallel to the upper surface of said handle, (4) a lower section having a first angle that extends downward from the lower surface of said handle, and a contiguous second angle that extends outward and upward from the first angle, wherein said second open-end head has four sides with three corners that correspond to the four sides and the three corners of a partial hexagon, with each of the corners having a notch that removes a section of the apex located at each of the three corners of the partial hexagon, d) a first head plate dimensioned to fit into the stepped first side of the first open-end head, e) a second head plate dimensioned to fit into the stepped second side of the first open-end head, f) a third head plate dimensioned to fit into the stepped first side of the second open-end head, g) a fourth head plate dimensioned to fit into the stepped second side of the second open-end head, and h) means for attaching said first, second, third and fourth head plates to the respective open-end heads of said double open-end claded-head wrench.

5. The wrench as specified in claim 1 wherein said wrench handle and the integrally attached first and second open-end heads are made of a metal that is softer than a metal used to make said first, second, third and fourth head plates.

6. The wrench as specified in claim 5 wherein said wrench handle and the integrally attached first and second open-ends head are made of an aluminum alloy and said first, second, third and fourth head plates are made of a hardened steel.

7. The wrench as specified in claim 4 wherein said wrench handle further comprises a plurality of openings.

8. The wrench as specified in claim 7 wherein said plurality of openings comprises a plurality of bores.

9. The wrench as specified in claim 7 wherein said plurality of openings comprises at least one elongated slot.

10. The wrench as specified in claim 1 wherein:

a) the thickness of said handle ranges from 0.25 to 0.5 inches (0.635 to 1.27 cm), b) the width of said handle ranges from 0.5 to 0.75 inches (1.27 to 1.91 cm), and c) the inward stepped first side, the stepped second side, and the thickness of said first, second, third and fourth plates range in thickness from 0.031 to 0.094 inches (0.79 to 0.24 cm).

11. The wrench as specified in claim 4 wherein said means for attaching said first, second, third and fourth plates to the respective open-end head comprises at least two blind rivets.

12. The wrench as specified in claim 4 wherein said means for attaching said first, second, third and fourth plates to the respective open-end head comprises a spot-welding process.

13. The wrench as specified in claim 9 wherein said means for attaching said first, second, third and fourth plates to the respective open-end head comprises an adhesive.

14. The wrench as specified in claim 4 wherein the first angle on said first open-end head that extends upward from the upper surface of said handle has a slope ranging from 30 to 40 degrees, and the second angle that extends outward and downward from the first angle has a slope ranging from 25 to 35 degrees.

15. The wrench as specified in claim 4 wherein the first angle on said second open-end that extends downward from the lower surface of said handle has a slope ranging from 30 to 40 degrees, and the second angle that extends outward and upward from the first angle has a slope ranging from 25 to 35 degrees.

16. The wrench as specified in claim 4 wherein said first and second open-end heads are designed to accommodate different sizes of bolts and nuts.

17. The wrench as specified in claim 16 wherein said first and second open-end heads are produced in various metric sizes that allow hexagon bolts and nuts measured in metric units to be tightened and loosened.

18. The wrench as specified in claim 16 wherein said first and second open-end heads are produced in various English sizes that allow hexagon bolts and nuts measured in inches to be tightened and loosened.

19. The wrench as specified in claim 4 further comprising a roll-up pouch that is dimensioned to store a set of said double open-end claded-head wrenches.

* * * * *